US012298101B2

(12) United States Patent
Planck et al.

(10) Patent No.: US 12,298,101 B2
(45) Date of Patent: May 13, 2025

(54) WEAPON SIGHT GRIP

(71) Applicant: Crimson Trace Corporation, Columbia, MO (US)

(72) Inventors: William A. Planck, Columbia, MO (US); Tim Meissen, Columbia, MO (US); Michael Cottrell, Ashland, MO (US); Shane Ball, Columbia, MO (US)

(73) Assignee: Crimson Trace Corporation, Columbia, MO (US)

( * ) Notice: Subject to any disclaimer, the term of this patent is extended or adjusted under 35 U.S.C. 154(b) by 0 days.

(21) Appl. No.: 18/053,302

(22) Filed: Nov. 7, 2022

(65) Prior Publication Data

US 2023/0147430 A1 May 11, 2023

Related U.S. Application Data

(60) Provisional application No. 63/263,684, filed on Nov. 7, 2021.

(51) Int. Cl.
*F41G 1/06* (2006.01)

(52) U.S. Cl.
CPC ..... *F41G 1/06* (2013.01)

(58) Field of Classification Search
CPC ... F41G 1/065; F41G 1/14; F41G 1/10; F41G 1/08; F41G 1/12; F41G 1/16; F41G 1/06
USPC ..... 42/137
See application file for complete search history.

(56) References Cited

U.S. PATENT DOCUMENTS

| | | | |
|---|---|---|---|
| 3,963,356 | A | 6/1976 | Wiklund |
| 4,665,622 | A | 5/1987 | Idan |
| 5,369,888 | A | 12/1994 | Kay et al. |
| 5,594,584 | A | 1/1997 | Kay et al. |
| 5,653,034 | A | 8/1997 | Bindon |
| 5,813,159 | A | 9/1998 | Kay et al. |
| 6,327,806 | B1 | 12/2001 | Paige |
| 6,519,889 | B1 | 2/2003 | Schlierbach et al. |
| 6,967,775 | B1 | 11/2005 | Millett |
| 7,069,685 | B2 | 7/2006 | Houde-Walter |
| 7,234,265 | B1 | 6/2007 | Cheng et al. |
| 7,325,354 | B2 | 2/2008 | Grauslys et al. |
| 7,454,860 | B2 | 11/2008 | Houde-Walter |
| 7,634,866 | B2 | 12/2009 | Javorsky |
| D612,006 | S | 3/2010 | Kohler |
| 7,676,137 | B2 | 3/2010 | Schick et al. |
| 7,721,481 | B2 | 5/2010 | Houde-Walter |

(Continued)

OTHER PUBLICATIONS

Design U.S. Pat. No. D. 1,000,576S, Issued Oct. 3, 2023, Inventor Jianhua Sun. This is being entered in NPL as the PTO/SB/08a (01/22) will not accept 10 Digit Design Patents under U.S. Patents.

(Continued)

*Primary Examiner* — John Cooper
(74) *Attorney, Agent, or Firm* — Stinson LLP

(57) ABSTRACT

A weapon sight grip and associated components and methods. The weapon sight can be a firearm sight, such as a red dot type sight. The firearm accessory includes a base configured to be connected to a weapon and a sighting portion configured to assist a user in aiming the weapon. The firearm accessory includes grip structure such as an elastomeric pad, ridge, or other structure configured to facilitate a user in gripping the sight, such as to rack a slide on which the sight is mounted.

17 Claims, 10 Drawing Sheets

(56) References Cited

U.S. PATENT DOCUMENTS

| | | | | |
|---|---|---|---|---|
| 7,796,329 | B2 | 9/2010 | Dobschal et al. | |
| 7,916,290 | B2 | 3/2011 | Koehler | |
| 8,082,688 | B2 | 12/2011 | Elpedes et al. | |
| 8,087,196 | B2 | 1/2012 | Jung et al. | |
| 8,099,897 | B2 | 1/2012 | Elpedes et al. | |
| 8,109,031 | B2 | 2/2012 | Tang et al. | |
| 8,186,093 | B1 | 5/2012 | Chung | |
| D662,566 | S | 6/2012 | Estes | |
| 8,215,050 | B2 | 7/2012 | Elpedes et al. | |
| 8,443,541 | B2 | 5/2013 | Elpedes et al. | |
| 8,578,646 | B2 | 11/2013 | Joannes | |
| 8,621,759 | B2 | 1/2014 | Reimer | |
| 8,671,611 | B2 | 3/2014 | Ostergren et al. | |
| 8,813,410 | B2 | 8/2014 | Jung et al. | |
| 8,879,146 | B2 | 11/2014 | LoRocco et al. | |
| 8,966,805 | B2 | 3/2015 | Koesler et al. | |
| 8,984,795 | B2 | 3/2015 | Jung et al. | |
| 8,997,392 | B1 | 4/2015 | Jung et al. | |
| 9,046,320 | B2 | 6/2015 | Keng et al. | |
| 9,146,076 | B2 | 9/2015 | Jung et al. | |
| D742,992 | S | 11/2015 | Arnedo Vera et al. | |
| 9,194,656 | B2 | 11/2015 | Jung et al. | |
| 9,354,022 | B2 | 5/2016 | Eriksson et al. | |
| 9,423,212 | B2 * | 8/2016 | Campean | F41G 1/345 |
| 9,470,478 | B2 | 10/2016 | Jung et al. | |
| 9,500,442 | B2 | 11/2016 | Collin et al. | |
| 9,593,906 | B1 | 3/2017 | Oz et al. | |
| D784,480 | S | 4/2017 | Oz et al. | |
| 9,671,195 | B2 | 6/2017 | Jeung | |
| RE46,487 | E | 7/2017 | Jung et al. | |
| 9,752,852 | B2 | 9/2017 | Collin et al. | |
| 9,752,853 | B2 | 9/2017 | Teetzel et al. | |
| 9,823,044 | B1 * | 11/2017 | Cabrera | F41G 1/30 |
| 9,869,526 | B1 | 1/2018 | Cheng et al. | |
| RE46,764 | E | 3/2018 | Jung et al. | |
| 9,945,638 | B2 | 4/2018 | Jeung | |
| 9,958,234 | B2 | 5/2018 | Campean | |
| 9,982,965 | B2 | 5/2018 | Sun | |
| 10,006,741 | B2 | 6/2018 | Jeung et al. | |
| 10,086,527 | B2 | 10/2018 | Teetzel et al. | |
| RE47,133 | E | 11/2018 | Jung et al. | |
| 10,139,197 | B1 | 11/2018 | Horton et al. | |
| 10,175,029 | B2 | 1/2019 | Teetzel et al. | |
| RE47,256 | E | 2/2019 | Jung et al. | |
| 10,228,217 | B2 | 3/2019 | Jeung et al. | |
| 10,234,238 | B1 | 3/2019 | Thomas et al. | |
| 10,240,898 | B2 | 3/2019 | Crispin | |
| D846,689 | S | 4/2019 | Cheng et al. | |
| D846,690 | S | 4/2019 | Cheng et al. | |
| D847,292 | S | 4/2019 | Hoff | |
| D848,567 | S | 5/2019 | Soejima | |
| D849,180 | S | 5/2019 | Cheng et al. | |
| 10,330,439 | B2 | 6/2019 | Jeung et al. | |
| D872,219 | S | 1/2020 | Horton et al. | |
| 10,563,955 | B2 | 2/2020 | Pniel et al. | |
| 10,598,463 | B2 | 3/2020 | Jeung | |
| 11,415,389 | B2 | 8/2022 | Sessions | |
| 11,530,901 | B2 * | 12/2022 | Brewer | F41G 11/002 |
| 11,549,768 | B1 * | 1/2023 | Pischke | F41G 1/06 |
| 11,614,225 | B1 | 3/2023 | Sabaldan Elpedes | |
| D1,025,274 | S * | 4/2024 | Sun | D22/109 |
| 2003/0012015 | A1 | 1/2003 | Schiller et al. | |
| 2009/0193705 | A1 | 8/2009 | LoRocco | |
| 2010/0095578 | A1 | 4/2010 | Elpedes et al. | |
| 2012/0151816 | A1 | 6/2012 | Kleck et al. | |
| 2013/0180152 | A1 * | 7/2013 | Speroni | F41G 1/35 42/99 |
| 2013/0263491 | A1 | 10/2013 | Jung et al. | |
| 2014/0096431 | A1 | 4/2014 | Tang | |
| 2014/0150325 | A1 | 6/2014 | Keng | |
| 2015/0198415 | A1 * | 7/2015 | Campean | F41G 1/30 42/137 |
| 2018/0017356 | A1 * | 1/2018 | Cabrera | F41G 1/345 |
| 2018/0292168 | A1 | 10/2018 | Borrico | |
| 2018/0372448 | A1 | 12/2018 | Noskowicz | |
| 2019/0120594 | A1 | 4/2019 | Teetzel et al. | |
| 2019/0204047 | A1 | 7/2019 | Jeung et al. | |
| 2019/0353454 | A1 | 11/2019 | Courtice | |
| 2019/0360777 | A1 | 11/2019 | Grace et al. | |
| 2020/0025515 | A1 | 1/2020 | Thomas et al. | |
| 2020/0025516 | A1 | 1/2020 | Mok | |
| 2020/0088495 | A1 | 3/2020 | Hamilton et al. | |
| 2020/0200507 | A1 * | 6/2020 | Curry | F41G 1/30 |
| 2021/0207928 | A1 * | 7/2021 | Brewer | F41G 1/16 |
| 2021/0293510 | A1 * | 9/2021 | Rosen | F41G 1/30 |
| 2021/0341255 | A1 | 11/2021 | Jeung | |
| 2022/0170718 | A1 * | 6/2022 | Reese | F41G 1/30 |
| 2022/0282953 | A1 | 9/2022 | Lee | |
| 2022/0390206 | A1 | 12/2022 | Hamilton | |
| 2022/0390207 | A1 | 12/2022 | Chavez | |
| 2023/0110642 | A1 * | 4/2023 | Planck | F41G 1/30 42/118 |
| 2023/0175813 | A1 | 6/2023 | Sabaldan Elpedes | |
| 2023/0176387 | A1 | 6/2023 | Sabaldan Elpedes | |
| 2023/0332865 | A1 * | 10/2023 | Wells | F41G 1/30 |

OTHER PUBLICATIONS

Design U.S. Pat. No. D. 1,003,331S, Issued Oct. 31, 2023, Inventor Travis C. Overfelt. This is being entered in NPL as the PTO/SB/08a (01/22) will not accept 10 Digit Design Patents under U.S. Patents.

Crimson Trace RAD Micro Compact, Amazon Online Product Page. Earliest Publication Date: Sep. 13, 2021. Date Accessed: Apr. 4, 2024. Retrieved from Internet URL: https://www.amazon.com/Crimson-Trace-Integrated-CoWitness-Competition/dp/B09FZGGTKT?th=1 (Year: 2021).

CT RAD Micro, Crimson Trace Online Product Page. Earliest Publication Date: Sep. 26, 2021. Date Accessed: Apr. 4, 2024. Retrieved from Internet URL: https://www.crimsontrace.com/products/electronic-sights/ct-rads/ (Year: 2021).

* cited by examiner

WEAPON SIGHT GRIP

CROSS-REFERENCE TO RELATED APPLICATION

The present application claims priority to U.S. Provisional Patent App. No. 63/263,684, filed Nov. 7, 2021, the entirety of which is hereby incorporated by reference.

FIELD

The present disclosure generally relates to weapon accessories, and more particularly to weapon sights.

BACKGROUND

Various types of weapon sights are used to assist a shooter in aiming the weapon. Improvements are needed.

SUMMARY

In one aspect, a pistol sight is for use on a pistol having a slide. The pistol sight comprises a base and a sighting portion. The base includes mount connection structure configured for connecting the pistol sight to the pistol. The sighting portion is supported by the base. The sighting portion is configured to assist a shooter of the firearm in aiming the firearm. The sighting portion includes a post extending upward above the base. The post includes a grip comprising elastomeric material defining a gripping surface arranged to be engaged by a finger of a user to grip the pistol sight to rack the slide of the pistol.

In another aspect, a pistol sight is for use on a pistol having a slide. The pistol sight comprises a base including mount connection structure configured for connecting the pistol sight to the pistol. The pistol sight comprises a sighting portion supported by the base. The sighting portion is configured to assist a shooter of the firearm in aiming the firearm. The sighting portion includes a post extending upward above the base. The post includes a ridge extending upward along the post. The ridge is arranged to be engaged by a finger of a user to grip the pistol sight to rack the slide of the pistol.

In another aspect, a pistol sight is for use on a pistol having a slide. The pistol sight comprises a base including mount connection structure configured for connecting the pistol sight to the pistol. The base includes an upstanding ridge arranged to be engaged by a finger of a user to grip the pistol sight to rack the slide of the pistol. The pistol sight includes a sighting portion supported by the base. The sighting portion being configured to assist a shooter of the firearm in aiming the firearm.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
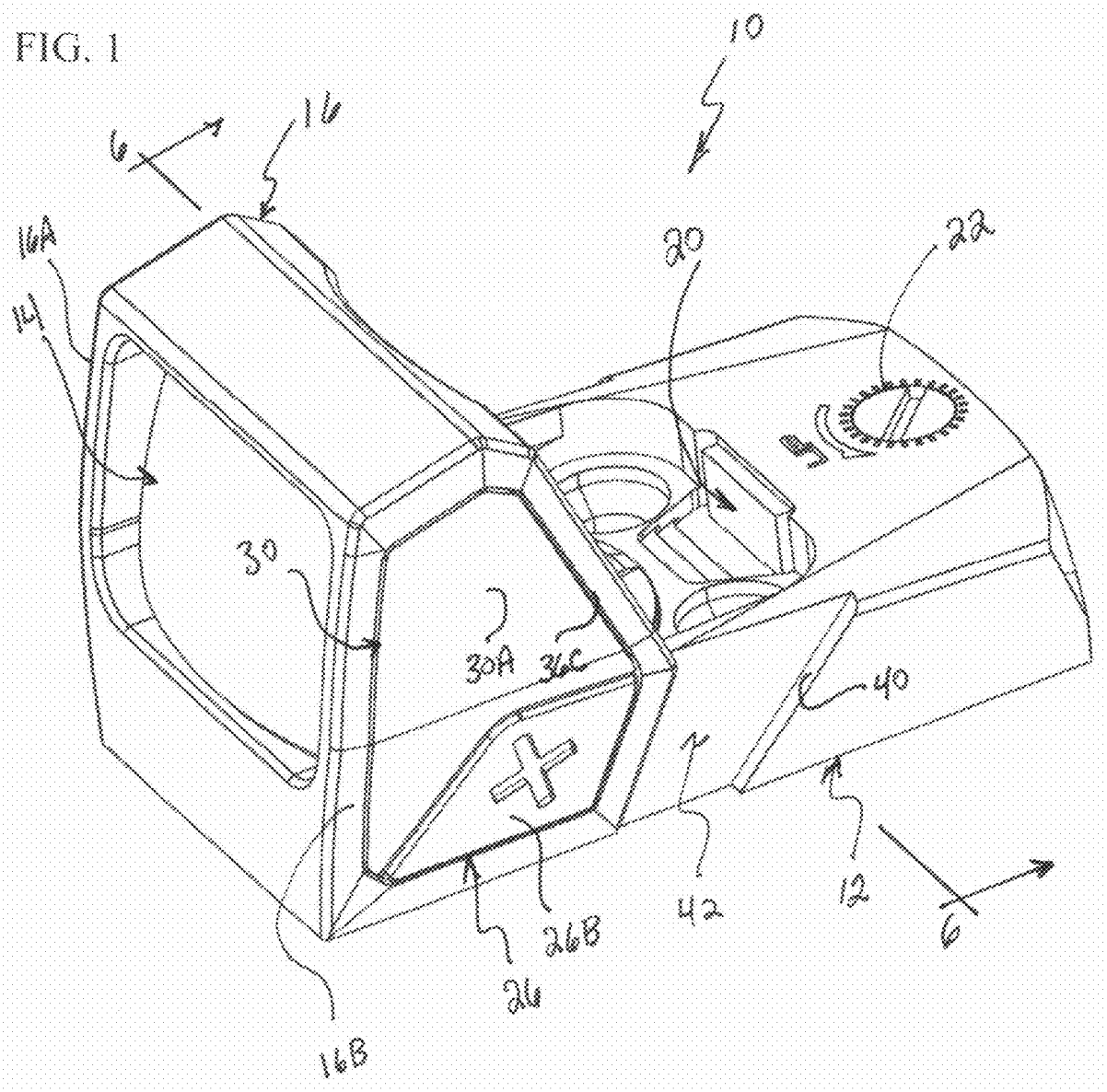
FIG. 1 is a front, left perspective of a firearm accessory of the present disclosure.

Referring to FIG. 1, a firearm sight of the present disclosure is indicated by 10. In the illustrated embodiment, the firearm sight is a "red dot" type sight configured to assist a shooter in aiming a firearm (e.g., pistol) at a target. It will be appreciated that aspects of the present disclosure can be implemented on other firearm accessories (e.g., other types of firearm sights) without departing from the scope of the present disclosure. The firearm sight 10 can be referred to broadly as a firearm accessory.

In general, the firearm sight 10 includes a base 12, an optical lens 14, and a lens support 16. Collectively, the lens and lens support can be referred to as a sighting portion. Moreover, the base and lens support can be referred to as a sight body, which can be formed of metal or another suitable material. In the illustrated embodiment, the base 12 is a generally rectangular structure having a forward end adjacent the lens 14 and having an opposite rear end. The base 12 is configured to be connected to a firearm, as described in further detail below. For example, the base 12 can include one or more openings through which a fastener (e.g., screw) can be passed to directly connect the base to the firearm or to connect the base to a mount that is connected to the firearm.

The lens 14 is arranged to permit a shooter to look through the lens when aiming the firearm. It will be appreciated that the firearm sight 10 includes a light source 20 housed in the rear portion of the base 12 that is configured to emit light forward toward the lens 14 to be reflected rearward to be seen by the shooter when the shooter is looking through the lens, as is common with red dot type sights. The reflected light (e.g., having the appearance of a red dot) is adjustable to locate the dot to correspond to a correct aiming point of the firearm to sight in or zero the firearm. For example, a first dial 22 (broadly, vertical adjustment actuator) can be used to change a vertical position of the dot as seen by the shooter, and a second dial 24 (broadly, horizontal adjustment actuator) can be used to change a horizontal position of the dot as seen by the shooter.

The lens support 16 extends around the lens 14 to protect the lens and to secure the lens in position with respect to the base 12. The lens support 16 includes a first post 16A on the right side of the lens and a second post 16B on the left side of the lens. The lens support includes a cross member 16C extending between upper ends of the posts 16A, 16B. Other configurations of lens supports can be used without departing form the scope of the present disclosure. Collectively, the lens support 16 and forward portion of the base 12 can be referred to as a shroud or frame that houses or supports the lens 14.

The sight 10 includes actuators 26 on the opposite left and right sides of the sight to enable a user to turn the sight on/off, adjust a mode of the sight, and/or change a brightness of the light source, etc. A battery 27 (broadly, power source)

is held in a battery compartment under a battery cover 28 and is operatively connected to the light source 20 for powering the light source responsive to actuation of the actuators 26.

Figure 5:
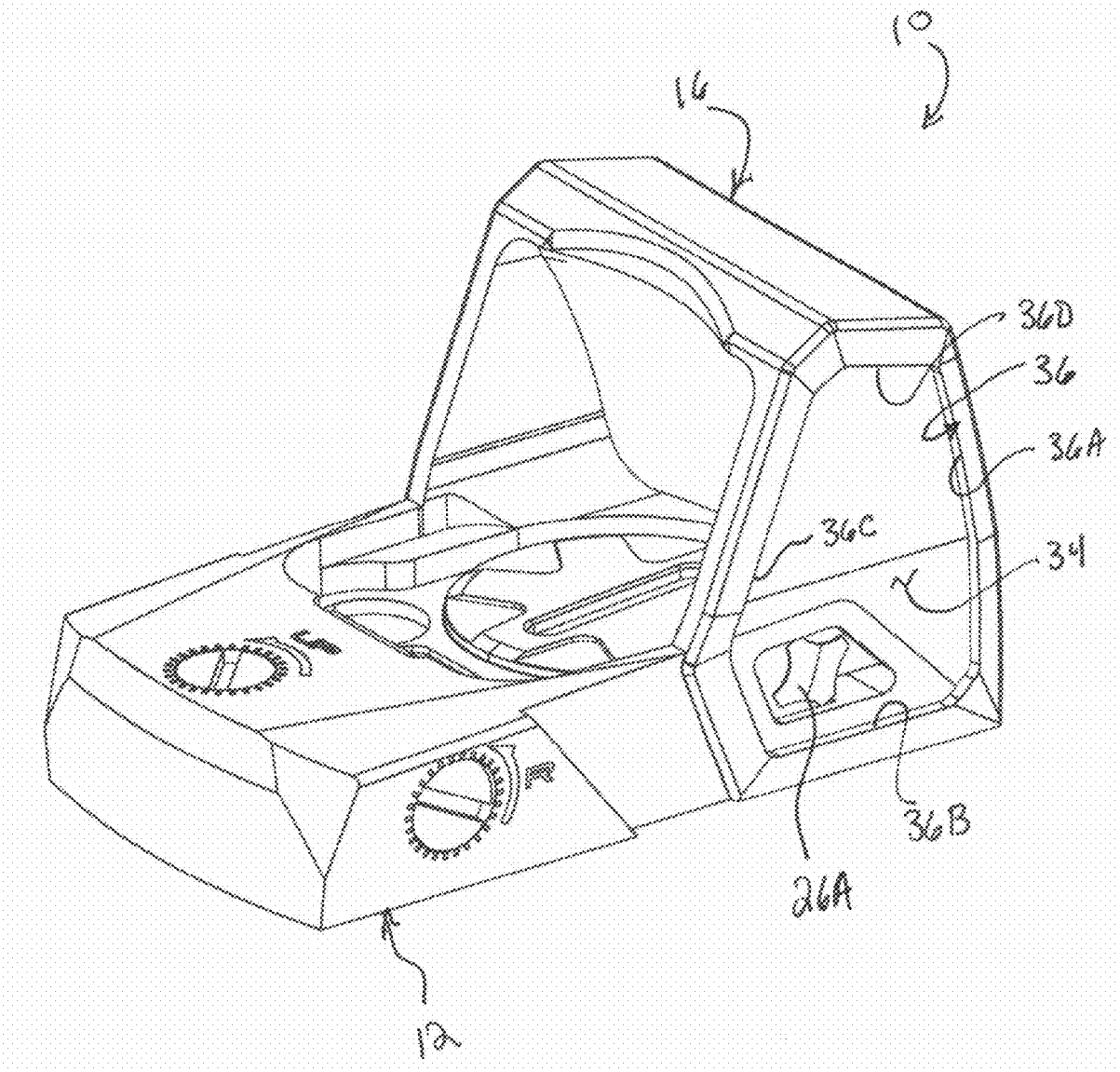
FIG. 5 is a view similar to FIG. 4 but omitting an actuator cover.
Figure 6:
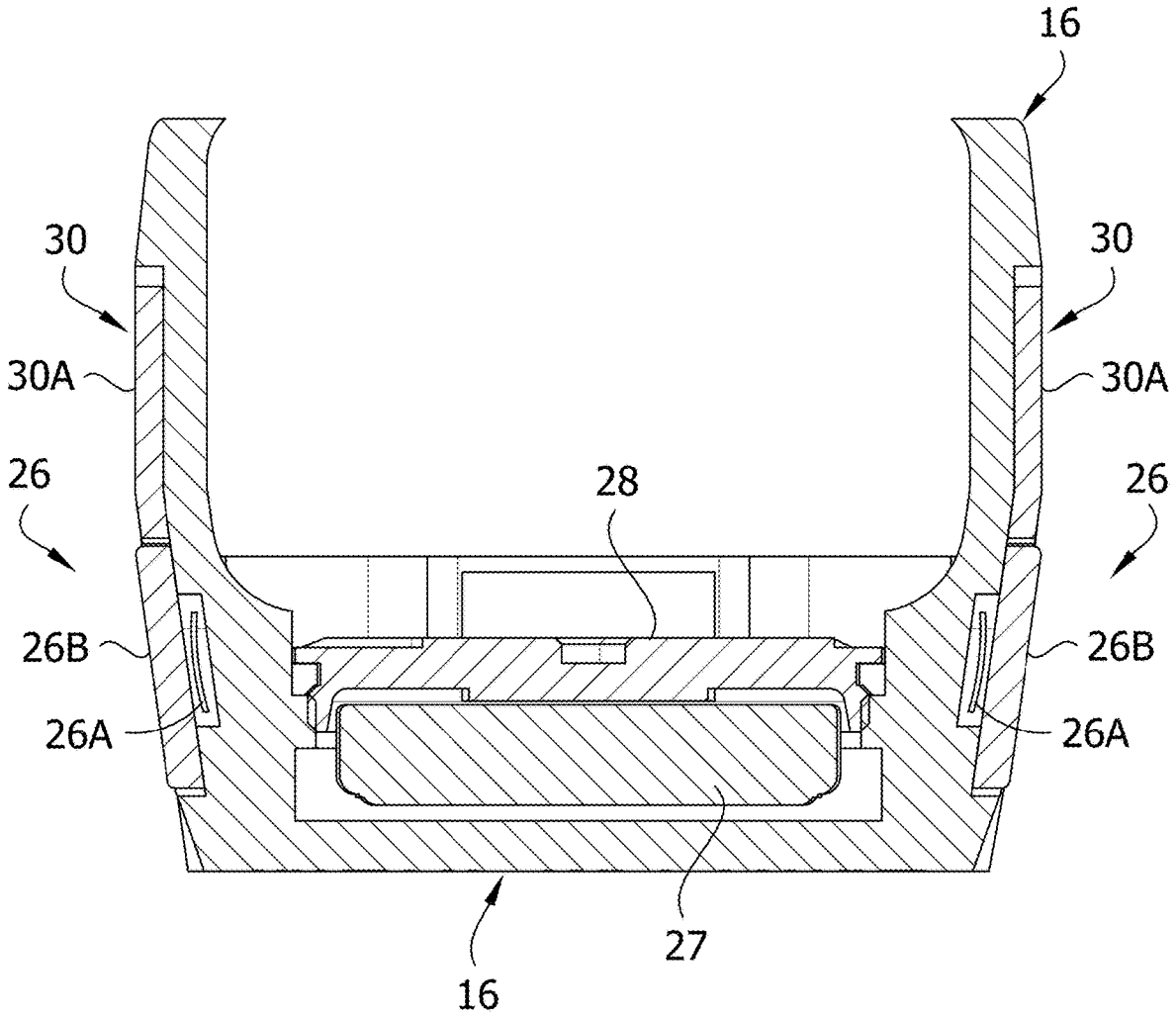
FIG. 6 is a section of the firearm accessory taken in a plane including line 6-6 of FIG. 1.

As shown in FIGS. 5 and 6, the actuators 26 each include a dome switch 26A (broadly, switch) and a cover 26B over the dome switch. The covers 26B can be pressed by a user to deform the dome switch 26A to actuate the actuator 26. Desirably, the covers 26B are formed of elastomeric material such as a type of rubber (e.g., TPU). The covers are flexible to permit a user to deform the dome switch by pressing the dome switch through the cover. In manufacture, the dome switches 26A are installed in recesses in the sight body and operatively coupled to circuitry of the sight in communication with the battery 27. The covers 26B can be installed over the dome switches 26A and secured in position, such as by adhesive. The left cover 26B has a "plus" indicator thereon, and the right cover 26B has a "minus" indicator thereon to represent that the actuators can be used to increase or decrease the brightness of the light source. The actuators 26 can be used for other functions, such as turning the sight on/off, without departing from the scope of the present disclosure.

Figure 7:
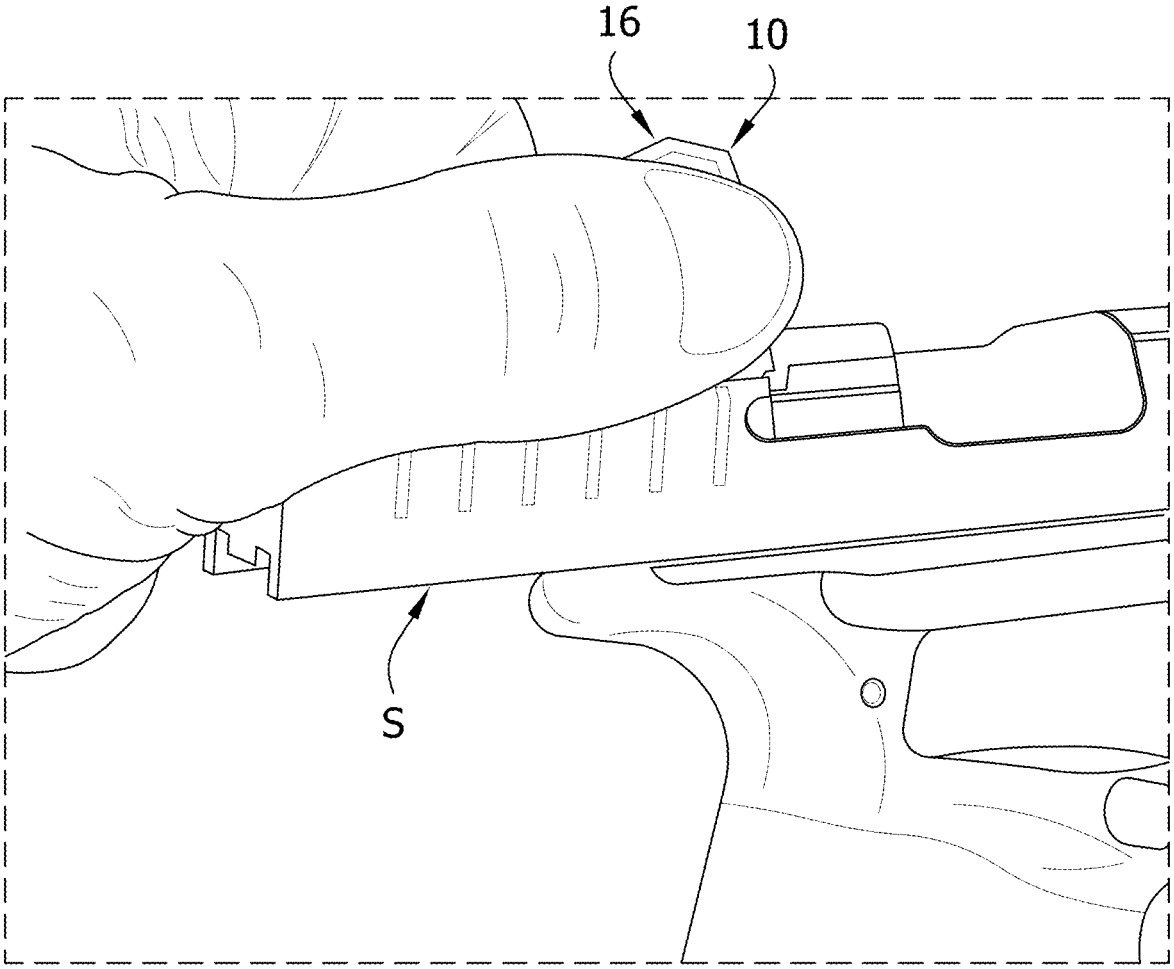
FIG. 7 is a photograph of the firearm accessory on a slide of a pistol and showing a hand of a user pinching the firearm accessory to rack the slide.

In the illustrated embodiment, the sight 20 includes grip structure on opposite sides of the sight to facilitate a user in gripping the sight (e.g., pinching the sight) between fingers of the user. This may be useful, for example, in facilitating a user to rack a slide of a firearm on which the sight is mounted. For example, FIG. 7 shows the sight 20 mounted on a slide S and being grasped by a user to actuate or rack the slide. The slide S may be racked to chamber a round of ammunition in the barrel of the pistol or to eject a chambered round. In an aspect, besides serving as a sight, the sight also serves as a racking aide to provide increased gripping surface for a user to more easily rack the slide. The sight includes various types of grip structure.

Figure 2:
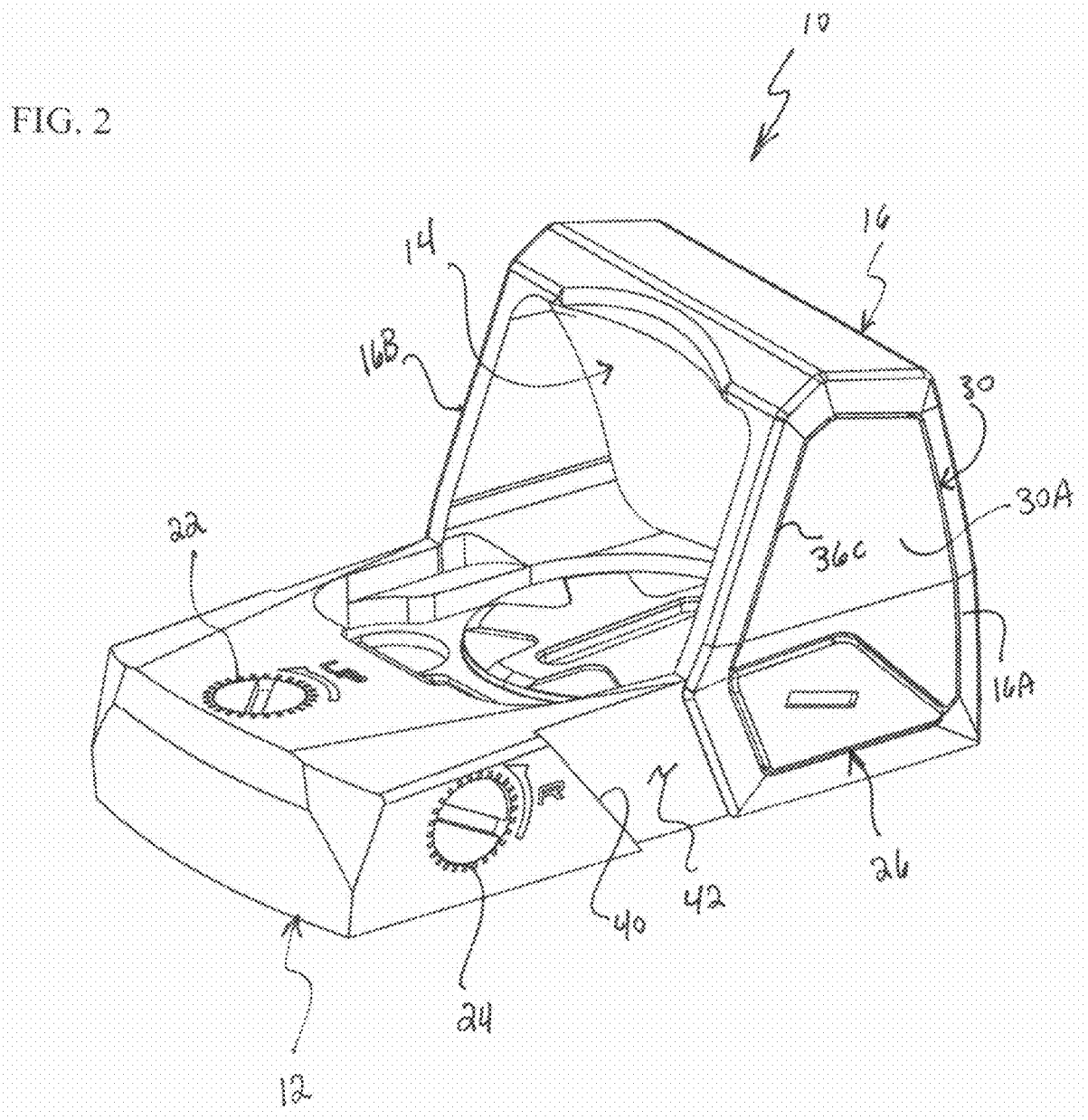
FIG. 2 is a rear, right perspective of the firearm accessory.
Figure 3:
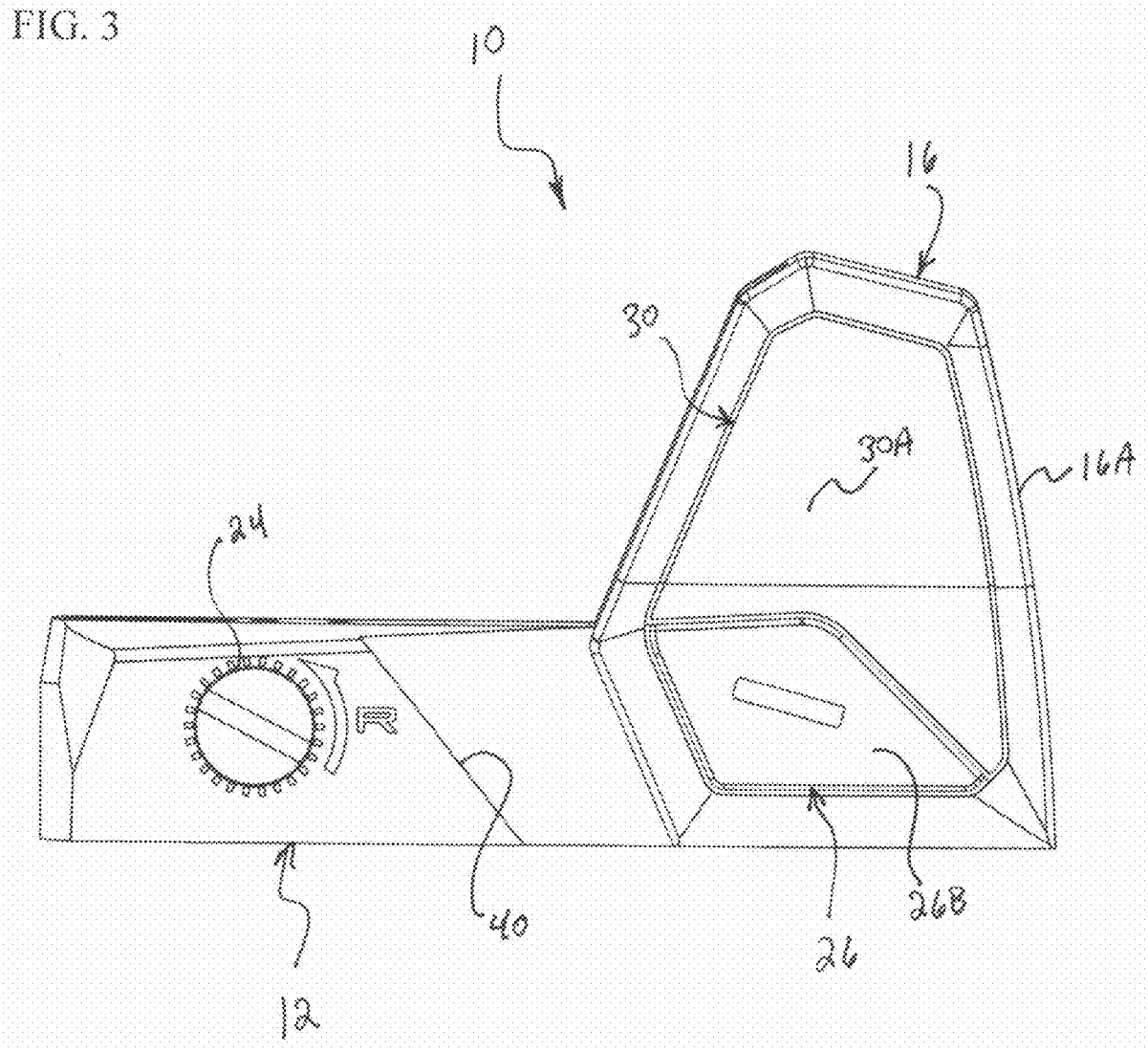
FIG. 3 is a right elevation of the firearm accessory.

Referring to FIGS. 1 and 2, the sight 10 includes grip features on the left and right sides of the sight. The sight 10 includes left and right first grip features comprising grip pads 30 applied to respective outboard left and right sides of the lens shroud. The grip pads 30 can be formed of elastomeric material such as a type of rubber (e.g., TPE). The grip pads 30 include respective gripping surfaces 30A arranged to face laterally away from the lens 14 in opposing directions with respect to each other. The arrangement is such that a user can "pinch" the sight by gripping the grip pads 30 on the opposite sides of the sight. Desirably, the material of the grip pads 30 and/or surface texture of the grip pads are configured to provide increased friction with the hand of the user.

Figure 4:
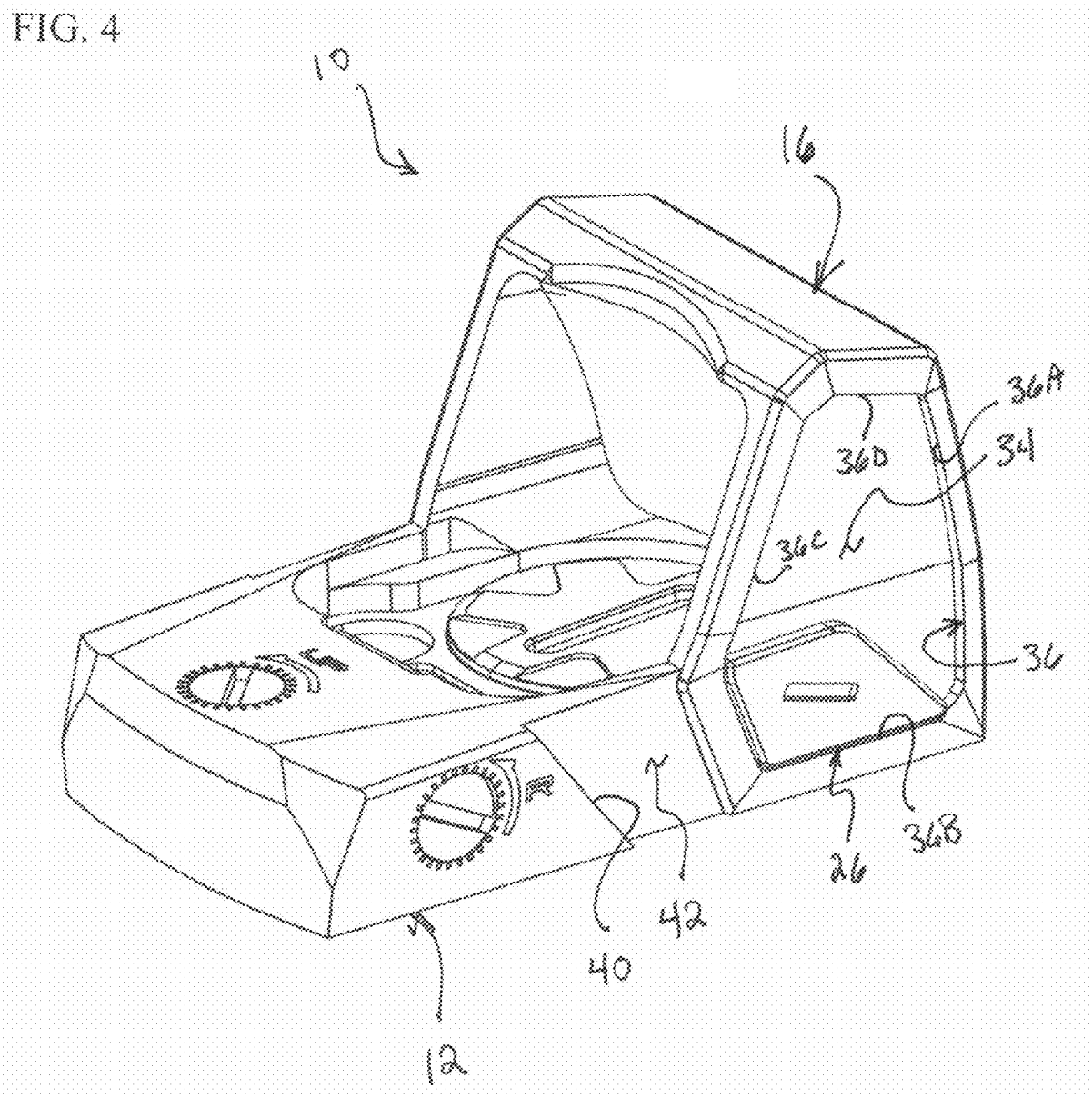
FIG. 4 is a rear, right perspective of the firearm accessory similar to FIG. 2, but omitting a grip pad.

Referring to FIGS. 4 and 5, the right grip pad 30 will be discussed in more detail, with the understanding that the left grip 30 pad has a similar (e.g., mirror image) construction and is mounted on the sight body in a similar fashion. As shown in FIG. 5, the sight body defines a recess 34 extending along substantially the full height of the lens shroud. The recess 34 includes a peripheral rim 36 that includes a forward ridge segment 36A, a lower ridge segment 36B, a rear ridge segment 36C, and an upper ridge segment 36D. The ridge segments bound a cavity in which the grip pad 30 and the actuator cover 26B are received. In the illustrated embodiment, the grip pad 30 and the actuator cover 26B are provided as separate pieces (see, e.g., FIG. 4), but it will be appreciated that they can be integrally formed without departing from the scope of the present disclosure. The grip pad 30 is sized and shaped to correspond closely to a size and shape of a portion of the cavity next to the actuator cover 26B. The grip pad 30 can be secured in position by adhesive or other suitable methods. Desirably, the grip pad 30 is resiliently compressible such that a user's finger pressing on the grip pad temporarily deforms the grip pad to increase friction between the user's finger and the grip pad. Although the grip pad 30 is shown as having a smooth outer gripping surface, the gripping surface can be textured (see, e.g., FIG. 8). In other embodiments, the grip pad may be formed of or include grip tape. Moreover, the gripping surfaces may be provided in similar locations as shown but be formed by textured or roughened surfaces of the sight body rather than a pad secured to the sight body.

The sight 10 includes additional grip features on the left and right sides of the sight. For example, the rear ridge segments 36C of the rim extending around the grip pad 30 acts as a grip enhancing feature. The rear ridge segment 36C is upstanding and defines a forward facing shoulder arranged to oppose force of a user's hand gripping the sight and pulling it rearward to rack the pistol slide. For example, if a user's hand is slipping off the rear end of the grip pad 30, the user's hand would engage the rear ridge segment 36C and help prevent the user's hand from slipping off the sight 10.

The sight 10 includes additional grip features in the form of additional ridges 40 on the left and right sides of the base 12. The ridge 40 is upstanding and defines a forward facing shoulder arranged to oppose force of a user's hand gripping the sight 10 and pulling it rearward to rack the pistol slide. A recess 42 is provided in the base of the sight in front of the ridge and behind the lens shroud.

It will be appreciated that the user may quickly move their hand to the sight 10 without looking to grip the sight to rack the pistol slide. The grip features of the present sight permit the user to engage the sight at various locations to facilitate manipulating the slide. One or more grip features disclosed herein can be omitted, and other types of grip features can be used, without departing from the scope of the present disclosure. Moreover, it will be appreciated that grip features disclosed herein can be provided on one or both sides of the sight.

Figure 8:
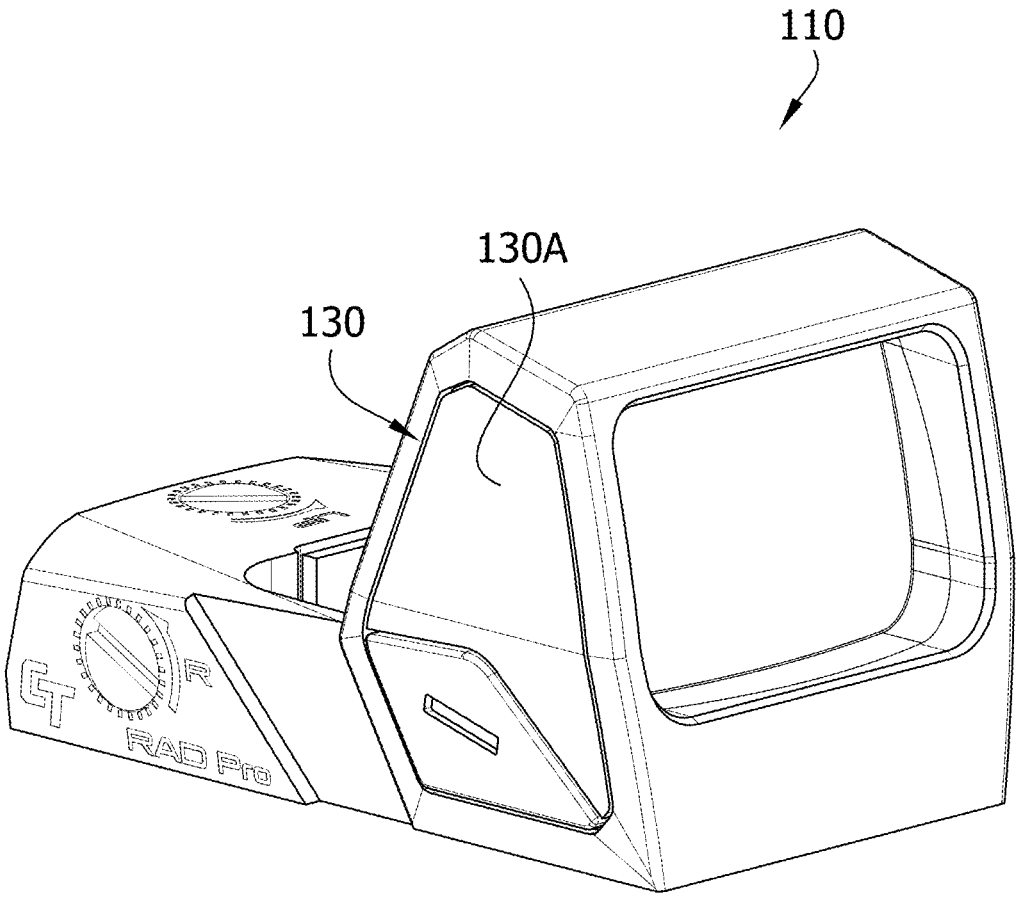
FIG. 8 is a front, right perspective of a second embodiment of a firearm accessory of the present disclosure.

Referring to FIG. 8, a second embodiment of a firearm sight of the present disclosure is indicated generally by 110. The sight is similar to the sight 10, and similar features are indicated by like reference numbers plus 100. For example, the sight includes grip pads 130 (only the right grip pad being shown). In this embodiment, the grip pads 130 have textured gripping surfaces 130A to increase friction with a user's hand. The texture includes a plurality of small protrusions to give the gripping surface a texture similar to that of sand paper. As with the grip pads 30 described above, the grip pads 130 can be formed of resiliently compressible material. It will be appreciated that the gripping surfaces can have other types of textures (e.g., plurality of ribs, knurled, etc.) without departing from the scope of the present disclosure.

Figure 9:
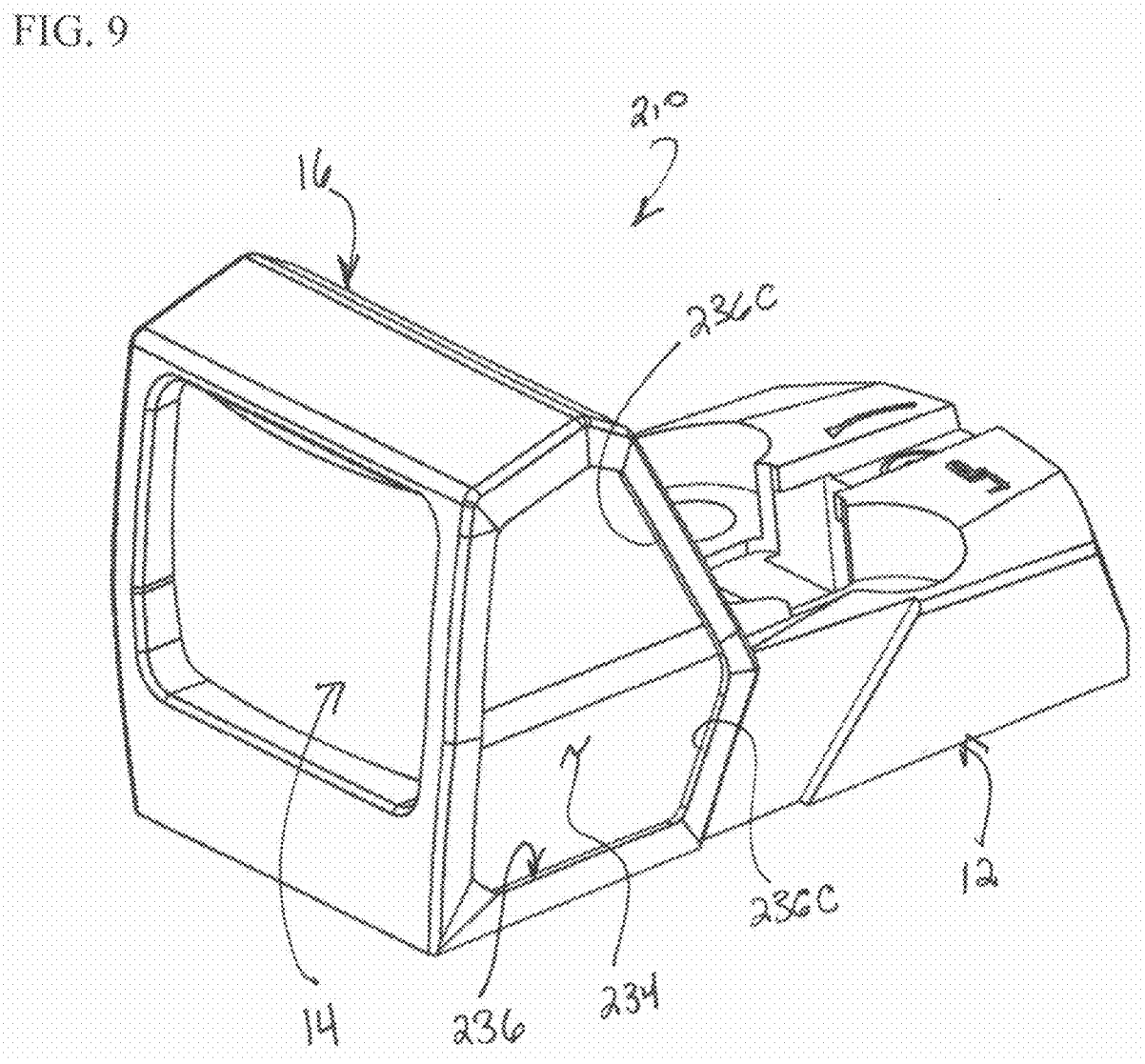
FIG. 9 is a front, left perspective of a third embodiment of a firearm accessory of the present disclosure.
Figure 10:
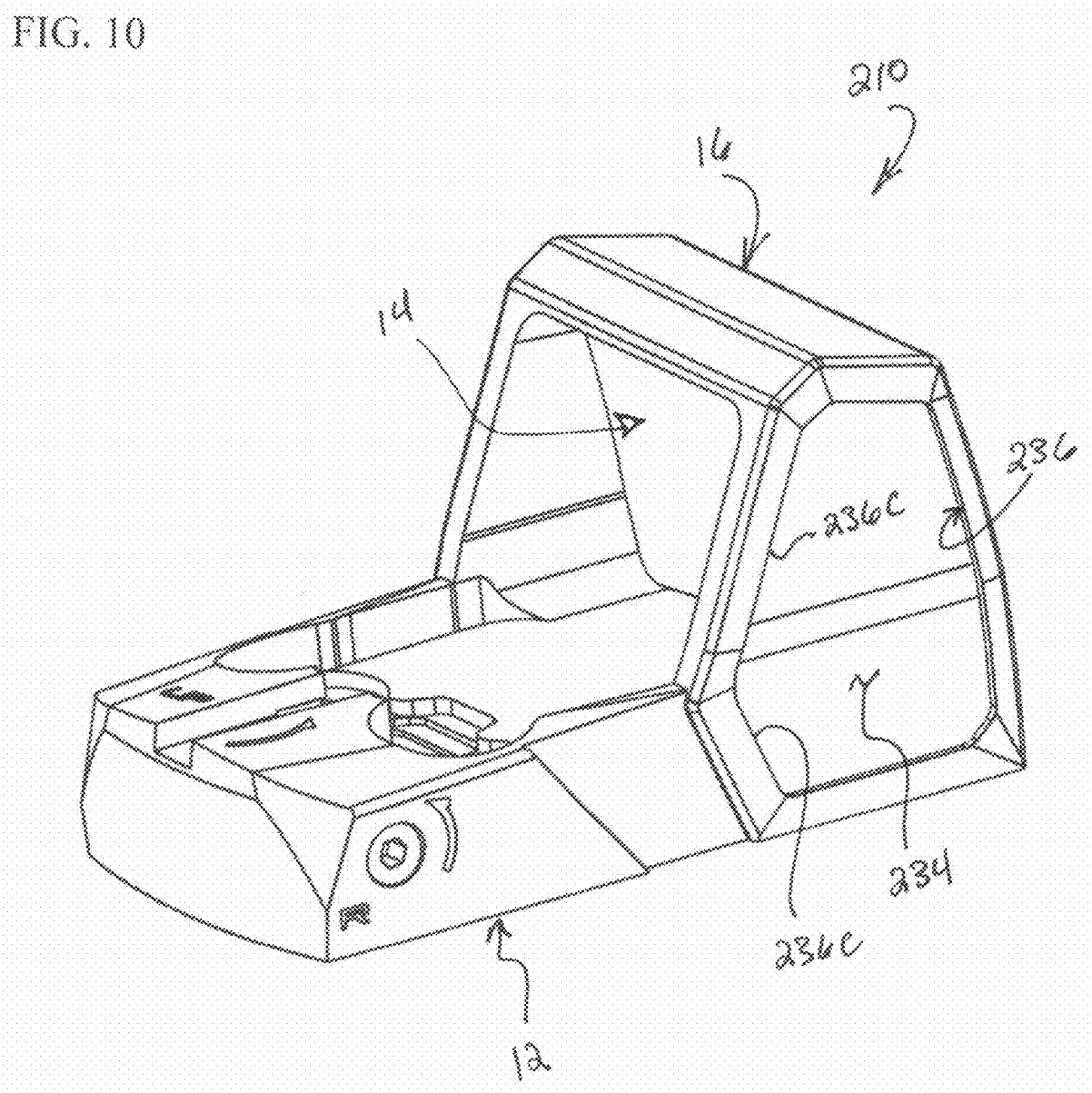
FIG. 10 is a rear, left perspective of the firearm accessory of FIG. 9.

Referring to FIGS. 9 and 10, a third embodiment of a firearm sight of the present disclosure is indicated generally by 210. The sight is similar to the sight 210, and similar features are indicated by like reference numbers plus 200. For example, the sight includes a base 12, a lens 14, and a lens support 16. In this embodiment, the grip pads are not provided, and the actuators on the sides of the lens shroud are omitted. The arrangement is such that the recesses 234 in the sides of the lens shroud are left open and are provided as grip features. In use, the user's fingers can be received in the recesses 234 to engage the ridge segments 236C to enhance grip of the sight for manipulating the slide. The outer surfaces of the lens shroud bounded by the peripheral rim 236 are shown as smooth surfaces but can be textured (e.g., knurled, ridged, etc.), without departing from the scope of the present disclosure.

In view of the above, it will be appreciated that the grip features provide traction to the user to grip the sight to perform pistol slide manipulations. The grip features increase the purchase area on each side of the slide to increase friction between the sight/slide and the user's thumb and other fingers on opposite sides of the sight/slide.

It will be apparent that modifications and variations are possible without departing from the scope of the invention defined in the appended claims. For example, mounting structure having other configurations (e.g., lacking sockets and/or holes) can be used without departing from the scope of the present disclosure. Moreover, it will be understood that a mounting adaptor could be part of the firearm or a separate component connectable to the firearm. The dimensions and proportions described herein are by way of example without limitation unless otherwise noted. Other dimensions and proportions can be used without departing from the scope of the present disclosure.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A pistol sight for use on a pistol having a slide, the pistol sight comprising:

a base including mount connection structure configured for connecting the pistol sight to the pistol; and a sighting portion supported by the base, the sighting portion being made of a first material and configured to assist a shooter of the firearm in aiming the firearm, the sighting portion including a post extending from the base upward above the base, the post including a grip comprising elastomeric material that is more compressible than the first material and attached to the first material of the sighting portion, the elastomeric material defining a gripping surface, wherein the gripping surface is recessed relative to the post and arranged to be engaged by a finger of a user to grip the pistol sight to rack the slide of the pistol.

2. The pistol sight as set forth in claim 1, wherein the sight portion defines a recess and the grip is disposed in the recess.

3. The pistol sight as set forth in claim 1, wherein the grip faces laterally outward from the base and sight portion.

4. The pistol sight as set forth in claim 1, wherein the post of the sighting portion comprises a first post located on a first side of the base, the sight portion further comprises a second post extending from the base upward above the base on a second side of the base opposite to the first side of the base, the second post including a grip comprising elastomeric material that is more compressible than the first material of the sighting portion and attached to the first material of the sighting portion, the elastomeric material defining a gripping surface arranged to be engaged by a finger of a user to grip the pistol sight to rack the slide of the pistol.

5. A pistol sight for use on a pistol having a slide, the pistol sight comprising:

a base including mount connection structure configured for connecting the pistol sight to the pistol; and a sighting portion supported by the base, the sighting portion being configured to assist a shooter of the firearm in aiming the firearm in a forward direction with respect to the pistol sight, the sighting portion including a post extending upward above the base, the post including a central portion facing laterally outward from one side of the base and sighting portion, the central portion defining a textured gripping surface, the sighting portion further including a ridge rearward from the central portion and extending laterally outward with respect to the central portion, the ridge defining a forward facing shoulder arranged to be engaged by a finger of a user to grip the pistol sight to rack the slide of the pistol.

6. The pistol sight as set forth in claim 5, wherein the base includes a first end remote from the sighting portion and an opposite second end where the sighting portion is located, the sighting portion including a first end and a second end, the first end of the sighting portion being located closer to the first end of the base than the second end of the sighting portion, the ridge being located adjacent to the first end of the sighting portion.

7. The pistol sight as set forth in claim 6, wherein the ridge comprises a first ridge, the post further comprising a second ridge extending laterally outward from the central portion, the first and second ridges bounding the central portion on two sides.

8. The pistol sight as set forth in claim 7, wherein the post further comprises a third ridge extending laterally outward from the central portion, the first, second and third ridges bounding the central portion on three sides.

9. The pistol sight as set forth in claim 5, wherein the ridge makes a skew angle at an intersection with the base.

10. The pistol sight as set forth in claim 5, wherein the post of the sighting portion comprises a first post located on a first side of the base, the sight portion further comprises a second post extending from the base upward above the base on a second side of the base opposite to the first side of the base, the second post including a central portion facing laterally outward from a side of the base opposite the of the first post, the sighting portion further including a second ridge extending laterally outward from the central portion of the second post, the ridge being arranged to be engaged by a finger of a user to grip the pistol sight to rack the slide of the pistol.

11. The pistol sight as set forth in claim 5, wherein the central portion includes an elastomeric grip pad forming the textured gripping surface.

12. A pistol sight for use on a pistol having a slide, the pistol sight comprising:

a base including mount connection structure configured for connecting the pistol sight to the pistol, the base including a top surface, a bottom surface and side surfaces extending between the top and bottom surfaces, a ridge projecting laterally outward from a first of the side surfaces of the base, the ridge being arranged to be engaged by a finger of a user to grip the pistol sight to rack the slide of the pistol, the ridge extending in a rearward direction as the ridge extends upward along the first of the side surfaces; and a sighting portion supported by the base and extending upward from the base and above the top surface of the base, the sighting portion being configured to assist a shooter of the firearm in aiming the firearm in a forward direction with respect to the pistol sight.

13. The pistol sight as set forth in claim 12, wherein the ridge comprises a first ridge, the pistol sight further comprising a second ridge projecting laterally outward from a second of the side surfaces of the base, the second ridge being adapted to be engaged by a finger of a user to grip the pistol sight to rack the slide of the pistol.

14. The pistol sight as set forth in claim 13, wherein the second ridge extends in the rearward direction as the second ridge extends upward along the second of the side surfaces.

15. A pistol sight for use on a pistol having a slide, the pistol sight comprising:

a base including mount connection structure configured for connecting the pistol sight to the pistol; and a sighting portion supported by the base, the sighting portion being configured to assist a shooter of the firearm in aiming the firearm in a forward direction with respect to the pistol sight, the sighting portion including a post extending upward above the base, the post including a central portion facing laterally outward from one side of the base and sighting portion, the central portion defining a gripping surface, the sighting portion further including a first ridge rearward from the central portion and extending laterally outward with respect to the central portion, the first ridge defining a forward facing shoulder arranged to be engaged by a finger of a user to grip the pistol sight to rack the slide of the pistol, the sighting portion including a second ridge extending laterally outward with respect to the central portion, the first and second ridges bounding the central portion on two sides.

16. The pistol sight as set forth in claim 15, wherein the sighting portion includes a third ridge extending laterally outward with respect to the central portion, the first, second and third ridges bounding the central portion on three sides.

17. The pistol sight as set forth in claim 15, wherein the base includes a first end remote from the sighting portion and an opposite second end where the sighting portion is located, the sighting portion including a first end and a second end, the first end of the sighting portion being located closer to the first end of the base than the second end of the sighting portion, the ridge being located adjacent to the first end of the sighting portion.

* * * * *